US005206445A

United States Patent [19]

Comley et al.

[11] Patent Number: 5,206,445

[45] Date of Patent: Apr. 27, 1993

[54] PROJECTION DEVICES

[76] Inventors: Jack W. Comley, 15 Perriors Close, Cheshunt, Hertfordshire EN7 6AX; Andrew D. S. McFarlane, Fourwinds, Widdington, Saffron Walden, Essex CB11 3SA, both of England

[21] Appl. No.: 695,384

[22] Filed: May 3, 1991

[30] Foreign Application Priority Data

Jul. 16, 1990 [GB] United Kingdom ..... 9015565.6

[51] Int. Cl.[5] ..... F41C 9/08

[52] U.S. Cl. ..... 42/105; 42/51; 42/70.06

[58] Field of Search ..... 42/105, 1.15, 1.16, 42/51, 70.06; 102/502, 501, 529

[56] References Cited

U.S. PATENT DOCUMENTS

| | | | |
|---|---|---|---|
| 723,603 | 3/1903 | Hazlehurst | 42/54 |
| 2,455,101 | 11/1948 | Stevens | 42/51 |
| 3,732,821 | 5/1973 | Royer | 102/502 |
| 3,733,727 | 5/1973 | Jones et al. | 102/502 |
| 3,791,303 | 2/1974 | Sweeney et al. | 102/502 |
| 3,865,038 | 2/1975 | Barr | 102/502 |
| 5,018,450 | 5/1991 | Smith | 102/502 |

FOREIGN PATENT DOCUMENTS

| | | | |
|---|---|---|---|
| 149255 | 11/1902 | Fed. Rep. of Germany . | |
| 328496 | 10/1918 | Fed. Rep. of Germany . | |
| 1298017 | 6/1969 | Fed. Rep. of Germany . | |
| 2445448 | 4/1976 | Fed. Rep. of Germany | 42/105 |
| 321195 | 9/1902 | France . | |
| 2389091 | 11/1978 | France . | |
| 0084338 | 9/1954 | Norway | 42/1.15 |
| 71596 | 10/1915 | Switzerland . | |

*Primary Examiner*—Michael J. Carone

*Attorney, Agent, or Firm*—Stevens, Davis, Miller & Mosher

[57] ABSTRACT

A projection device for firing e.g. a squash ball comprises a one-piece plastics body with a transverse bore in which a trigger plunger is seated. The squash ball seats in a flaring muzzle cavity at the front end of the body. A blank cartridge is loaded into a firing chamber immediately behind the muzzle cavity, and having a breech formed by the front surface of the trigger plunger. The trigger plunger is pierced by an opening which, when the plunger is depressed, allows a sprung firing pin to move forward and fire the cartridge to eject the squash ball at high velocity. To prevent inadvertent discharge of the device, the head of the plunger is restrained by a withdrawable split pin and also by a hinging spring clip.

29 Claims, 2 Drawing Sheets

PROJECTION DEVICES

FIELD OF THE INVENTION

This invention relates to hand-held projection devices, and particularly to short-range devices for firing soft, elastic or low density projectiles.

BACKGROUND OF THE INVENTION

In the prior art, a number of devices have been proposed and used for projecting missiles of various types in a less than lethal manner. These include in particular the various kinetic energy systems for firing baton rounds or "plastic bullets". These have involved heavy purpose-built reloadable guns, of a bulky and designedly threatening appearance. They are awkward to handle and can be very dangerous at short ranges.

SUMMARY OF THE INVENTION

In one aspect of this invention, we have addressed the new task of providing a projection device which can be used for short-range less than lethal personal protection. In this aspect, the invention provides a projection device adapted to be carried in and fired by one hand, comprising a body which has a grip portion to be gripped by the hand and incorporates a firing chamber for a propellant charge; the body furthermore defines an enlarged front muzzle opening in which is retained, e.g. by adhesion, a soft projectile, preferably an elastomeric ball and most preferably a squash ball, there being a trigger on the body operable by the hand holding the grip portion to cause the charge to be set off and hence fire the projectile from the muzzle.

Desirably the muzzle is a forward continuation of the grip portion so that the device can be held and aimed like a torch.

Many people are familiar with the stopping effect of a rapidly-travelling squash ball, and we find that a projectile of this type in a compact, close-range one-handed device makes for effective less than lethal protection.

The projectile desirably weighs between 10 and 50 grams, more preferably between 20 and 30 grams. As has been mentioned, an ordinary squash ball is very suitable.

To be effective without being excessively dangerous, the energy imparted to the projectile should be less than 200 J, more preferably less than about 100 J and most preferably between 40 and 70 J.

The projectile is desirably seated in the device at, adjacent or projecting from the muzzle opening. A long barrel is awkward, and aim is not critical at the short ranges under consideration here. Furthermore a very short barrel maximises firing noise and hence deterrent effect.

In a second aspect, we consider particularly the firing mechanism.

In this aspect, a projection device comprises a generally elongate body with a grip portion by which the device can be carried in one hand. The front end of the body has an enlarged muzzle cup opening facing forwardly, generally along the body's longitudinal direction, i.e. as a forward continuation from the grip portion. In the body behind the muzzle is a firing chamber for a propellant charge e.g. a blank cartridge. Behind the firing chamber are a trigger piece and a firing pin, generally spring-loaded, for firing the propellant charge. Movement of the trigger piece in the body, by a triggering action of a hand gripping the grip portion, preferably against a spring bias, brings the device from a standby condition in which the firing pin is kept away from the firing chamber by a blocking part, to a firing condition in which relative transverse movement of the blocking part and firing pin allows the firing pin past the blocking part, to come forward and fire the charge. Usually the firing pin is transversely fixed, and the blocking part is on the trigger piece so that the firing pin lies generally behind the trigger piece. Advantageously the trigger piece acts also as a breech, closing off the rear end of the firing chamber. The trigger action may bring an aperture of the trigger piece, adjacent the blocking part, into register with the line of action of the firing pin to allow the pin forward to the breech which usually will have a small opening to let the pin hit the charge.

The trigger piece is preferably slidably moveable in the body, transversely to the longitudinal direction of the body. Preferably it takes the form of a plunger which emerges to the exterior of the device to be pressed directly by the user in the triggering action.

In a further aspect, we provide a projection device comprising a generally elongate body having an axis of elongation, a front end and a rear end, and grippable in one hand with the hand around the axis of elongation at a grip portion thereof, the device comprising an axially forwardly-opening enlarged muzzle defined by the front of the body for receiving a low-density projectile to be fired by the device;

an axial firing chamber disposed in the body behind the muzzle;

a plunger bore extending transversely in the body across the rear of the firing chamber, with a trigger plunger slidable in the bore and providing a breech surface for the firing chamber, and a forwardly-biased firing pin disposed axially in the body rearwardly of the plunger bore and extending inside the grip portion of the body;

the plunger having a standby condition in which a stop portion thereof restrains forward movement of the firing pin, and a depressed, firing condition in which a recess of the plunger allows the firing pin to travel forwardly to the firing chamber.

Since the trigger element and firing portion can lie largely within the grip portion of the body the device can be kept compact, particularly since the firing chamber is usually immediately in front of the trigger element and the muzzle recess—itself usually very short for reasons explained above—immediately in front of the firing chamber.

In either aspect the body including the muzzle and grip portion may be made as an integrated unit, preferably a hard polymer molding which for strength and simplicity may have these parts in one piece. The firing chamber is generally immediately behind the enlarged muzzle opening and may be separated from it by a diaphragm, destroyed on firing. Usually the body will hold only one charge. The firing chamber is preferably fixed—usually an integral cavity—in the body and desirably cannot be accessed without dismantling the firing mechanism. The relatively narrow passage from the propellant charge to the enlarged muzzle opening where the projectile seats is usually less than 4 cm and preferably less than 3 cm.

Furthermore it is particularly preferred that the device once fired cannot be fired again. Various features can contribute to this. Where the body includes or consists of plastics, firing may so damage the firing chamber, muzzle region, a passage between them, and any diaphragm as mentioned above, as to render reloading impossible. Accordingly, one or more of these portions may be at least partially defined by polymeric material comprised in the body, so as to be damaged on firing. Additionally or alternatively, the firing mechanism may be such that once the trigger element has moved to the firing condition it cannot move back to the standby condition, e.g. because it is held in by the spent firing pin. Thus the device, which can be made cheaply, may be treated as a round of ammunition; if it is lost or discarded after firing there is no hazard since it is impossible to use it again.

An important aspect of the device is that it should be compact so as to be carried and operated by one hand. To this end it should normally be less than 30 cm in length, preferably 10 to 20 cm, and more preferably 13 to 18 cm. A maximum transverse dimension of the grip portion is preferably 3 to 6 cm, more preferably 4 to 5 cm. The maximum overall transverse dimension (usually largest at the muzzle) is preferably not more than 8 cm and more preferably not more than 6 cm.

These suggested dimensions relate to the body and do not take into account any lanyard or the like which may be attached.

In a still further aspect, we provide a hand-held self-protection device, comprising (a) a unitary molded plastics body having a front end and a rear end, and defining an axial direction, the body comprising a grip portion grippable in one hand, and being less than 30 cm long;

(b) a trigger mounted on the body, operable by a said hand holding the grip portion;

(c) a front muzzle cup defined at the front end of the body, and a soft elastomeric projectile stuck in the front muzzle cup;

(d) a firing chamber defined in the body behind the projectile, and a blank cartridge in the firing chamber; and (e) firing mechanism in the body, actuable by operation of the trigger to fire the blank cartridge and thereby blow the projectile out of the front muzzle cup.

An important preferred aspect concerns the provision of safety measures for preventing inadvertent firing of the device. We prefer to provide at least one, and preferably two, safety arrangement which can prevent (i) operation of the trigger and/or (ii) firing of the device even if the trigger is operated, unless the safety device is either physically removed from the device or switched from a safety condition to a standby condition without removal from the device.

BRIEF DESCRIPTION OF THE DRAWINGS

An embodiment of the invention is now described in detail by way of example, with reference to the accompanying drawings in which.

DETAILED DESCRIPTION OF THE PREFERRED EMBODIMENT

Figure 2:
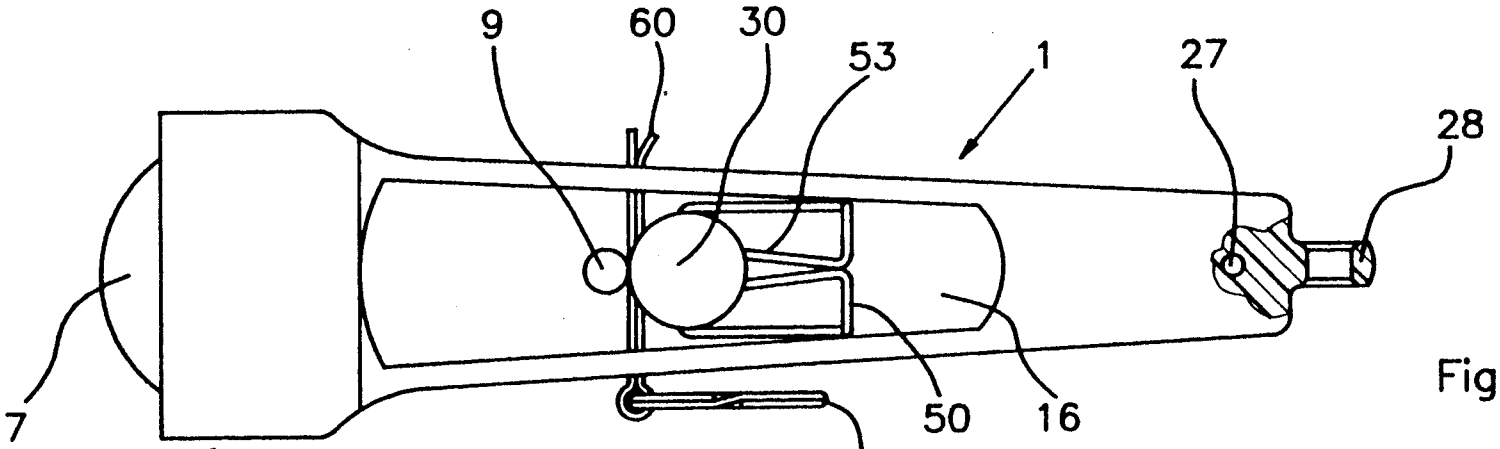
FIG. 2 is a top view of the device.
Figure 1:
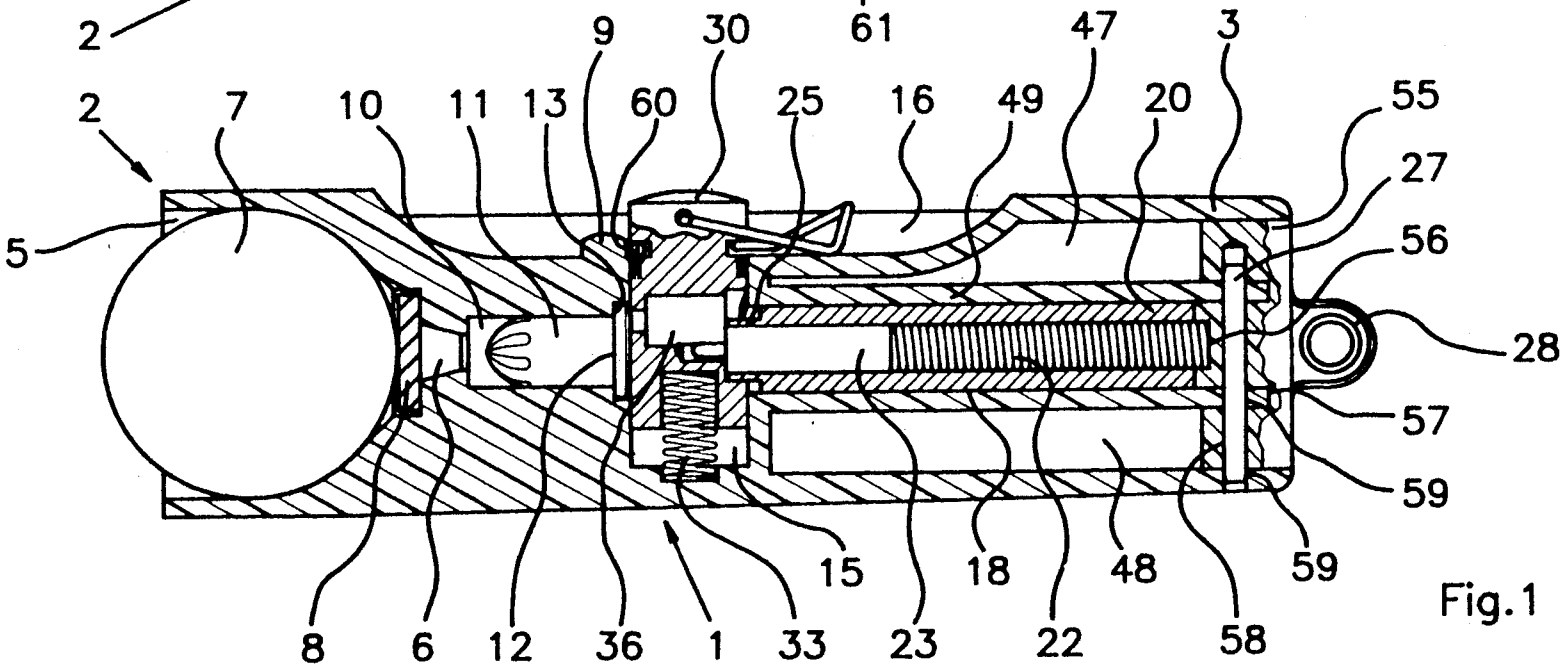
FIG. 1 is a vertical section through a short-range self-protection device.

Referring firstly to FIGS. 1 and 2, the device has a body 1 which is a one-piece moulding of glass-reinforced nylon. From the side the body has a generally rectangular section with a slight taper from the muzzle 2 to the rear of the body at the back of the grip section 3. The muzzle section 2 is substantially cylindrical but the grip portion 3 is substantially less wide than it is high; generally about half the dimension and tapering towards the rear. Overall, the body is 15 to 17 cm long.

The muzzle opening is a cup-shaped cavity 5, at its mouth occupying substantially the transverse area of the body, but tapering rapidly rearwardly to a funnel-shaped constriction 6. The converging walls are given a partly spherical curvature, and against them is seated an ordinary squash ball 7 which occupies substantially the entire muzzle cavity 5, projecting forwardly from its opening, and is glued into it so that it will not fall out as the device is handled. The squash ball is a standard "red dot", weighing about 24 g.

Seated on a ledge in the converging walls of the muzzle cavity 5, immediately rearwardly adjacent the squash ball 7, is a light resilient disc 8 e.g. of rubber or of fibre material, which separates it from the constriction 6. The purpose of this will be described later.

Lying directly behind the constriction or throat 6 on the longitudinal axis of the body is a firing chamber 10. In other embodiments a thin diaphragm may be fixed across the throat to block it, if possible formed integrally with the body. Firing chamber 10 is a longitudinal cylindrical bore 2 to 2.5 cm in length and fitting a 9 mm (0.38 inches) blank cartridge 11 which is preassembled into the chamber 10. The rear rim 12 of the cartridge seats against a small rearwardly-facing annular shoulder 13 at the back of the chamber 10, to hold the cartridge 11 in place. The distance between the firing chamber 10 and the squash ball 7, formed by the disc 8 and passage 6, is about 1 cm. The centre of the cartridge 11 is only about 2 cm away from the squash ball.

The rear end of the chamber 10 communicates with a cylindrical plunger bore 15 about half-way along the body 1. The bore 15 extends vertically down into the body from the centre of its top surface (where there is a general inward recess 16) through the centre of the body and approaching its lower surface.

At the rear of the plunger bore 15 a longitudinal rear bore 18 opens in coaxial register with the firing chamber 10, and extends axially right to the rear end of the body, through the grip portion. The rear bore 18 is occupied by a firing pin guide 20. This is a cylindrical aluminium tube and a close fit in bore 18, into which it may be sealed by adhesive. It has a coaxial interior pin bore 21. A firing pin spring 22 occupies the rear end of this bore 21, under compression, and a firing pin 23 seats on the front end of the spring 22. Firing pin 23 is an aluminium cylinder which fits closely into the bore 21 of the tube 20 and has at its front end a small-diameter pin protrusion 24 designed to strike against the cap of cartridge 11 under the influence of spring 22.

The body moulding may be made solid around the various components. For lightness, however, it is preferred to include one or more body voids in particular in the grip portion 3 where the firing stresses are lower. In the construction illustrated, upper and lower voids 47,48 are moulded in, respectively above and below a central bridging portion 49 through which bore 18 is defined. Voids 47,48 and bore 18 are initially open to the rear of the body. Once the firing pin guide 20, pin 23 an spring 22 have been installed in the bore 18 an end closure member 55, made of the same hard reinforced plastics as the body, is pushed into the rear opening. Closure member 55 has a central reaction seating 56 for the rear end of the spring 22, slots 57 in which the end of the bridging portion 49 seats, and a transverse pin-hole 58 which comes into register with corresponding pin-holes 59 in the bridging portion and the bottom outside wall of the body rear end. Holes 58,59 can be formed together by drilling after assembly. A metal fixing pin 27 (see FIG. 1) is then pushed right into these aligned holes—from which it cannot then be extracted since none is left projecting—to fix the closure member and hence also the firing pin assembly against axial displacement. The rear side of the closure member 55 has a flat ring 28 which projects rearwardly of the body, to attach a lanyard or the like (not shown).

The extreme front end of firing pin guide 20 is a reduced-diameter cylindrical portion 25 which projects slightly into the plunger bore 15.

In the plunger bore 15 between the openings of the firing chamber 10 and rear bore 18 is a generally cylindrical firing plunger 30. See also FIG. 3. This is an aluminium cylinder fitting closely into plunger bore 15 and with a domed head 31 projecting out of the body in recess 16 as a trigger to be actuated by the user's thumb. The bottom of the cylinder has a cylindrical recess 32 which receives the upper end of a plunger spring 33, the lower end of which engages the bottom of plunger bore 15 to bias the plunger 30 upwards. Plunger 30 has a central portion which, by pressing the plunger, can be brought into correspondence with the openings of chamber 10 and bore 18. The front face 34 of this portion is smoothly cylindrical except for a small cylindrical firing hole 35 sized to accommodate the firing pin protrusion 24. Extending coaxially rearwardly through the plunger 30 from the firing hole 35 is a larger diameter cylindrical cavity 36 which, in the depressed condition of the plunger 30, accommodates the front of the body of the firing pin 23. Cavity 36 opens rearwardly in a flat rearwardly-facing chordal stop surface 38, recessed into the rear of the plunger 30. Most of the stop surface 38 extends downwardly from the opening of cavity 36, and just below that opening has a small forwardly-extending and upwardly-open slot 39 to accommodate the firing pin protrusion 24 when the plunger 30 is in its upper condition as seen in FIG. 1. In this condition the front surface of the firing pin body 23 butts against the stop surface 38 of the plunger 30 which prevents the pin from travelling forward.

Figure 3A:
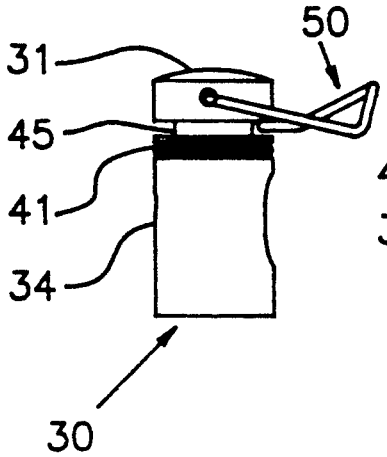
FIGS. 3*a*, 3*b* and 3*c* are respectively a side view, rear view and side section of a firing plunger of the device.
Figure 3B:
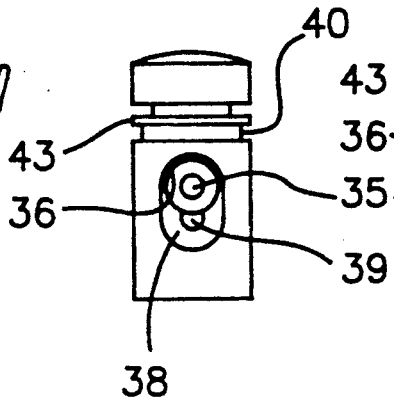
Figure 3C:
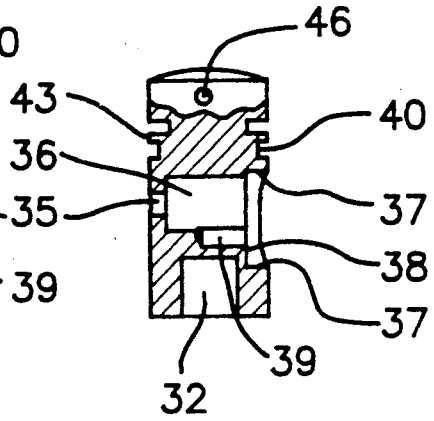

The recess of the stop surface 38 also receives the projecting front end 25 of the firing pin guide 20, and its semicircular upper and lower extremes 37 (FIG. 3(*c*)) limit the downward and upward stroke of the plunger by abutment against that housing end 25.

Above its central portion, firing plunger 30 has an annular circumferential groove 40 in which is seated a sealing ring 41 e.g. of nitrile rubber, which seals the bores and chambers from the exterior. This is shown in FIG. 3(*a*) and in FIG. 1.

Just above sealing ring 41, and separated from it by a narrow flange 43, is a deeper circumferential check groove 45 which demarcates the domed head 31 of the plunger 30. Head 31 is pierced by a small transverse bore 46 in which are engaged the two ends 51 of a spring safety clip 50.

Figure 4A:
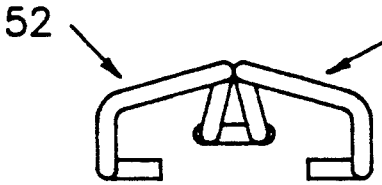
FIG. 4*a* is a rear view of a wire safety clip and FIG. 4*b* is a side view thereof.
Figure 4B:
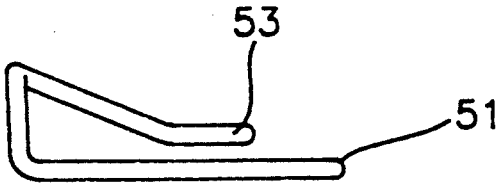
Figure 5:
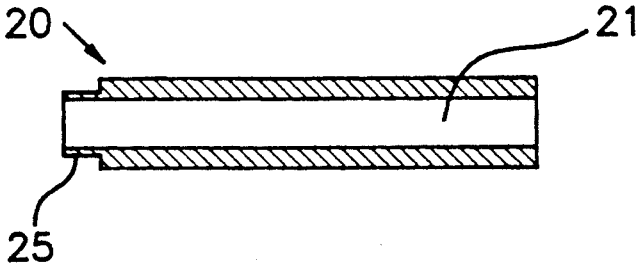
FIG. 5 is a sectioned view of a firing pin guide.
Figure 6:
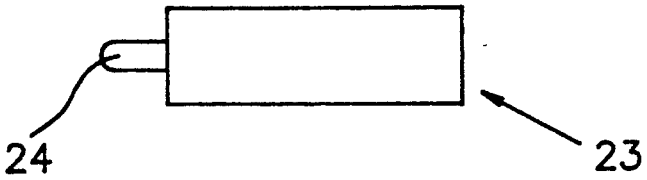
FIG. 6 shows a firing pin.

Clip 50 is made of springy steel wire and is seen in its rest condition in FIG. 4. Its long outer sides extend straight rearwardly from the inturned and opposed front ends 51, then turn inwardly and upwardly to form a rearwardly-facing inverted-U shaped arch or opening 52; from their meeting at the top of the opening 52 the two sides then extend forward and down to meet in a checking loop 53 slightly above the level of the outer sides. FIGS. 1 and 3(*a*) show the clip 50 fitted to the plunger 30 with the check loop 53 resiliently deformed downwardly relative to the outer limbs of the clip and projecting into the rear of check groove 45 below the plunger head. As can be seen in FIG. 1, check loop 53 of clip 50 also butts against the top body surface in the recess 16 just behind the opening of plunger bore 15. Hence in this condition it is not possible to depress the plunger.

The device also has a safety split pin 60 which is fitted, as shown in FIGS. 1 and 2, through holes in the body at the sides of the recess 16, in register with the front part of the check groove 45 of the plunger. The split pin thus engages this groove as can be seen in the figures, and provides further means preventing depression of the plunger. A pull ring 61 is linked to one end of the split pin 60. An upward projection on the base of the recess 16—here a stud 9—is provided in front of the split pin so that it cannot bend forward out of engagement.

Operation of the device is as follows. Normally it is stored with both safety pin 60 and safety spring clip 50 in place as shown. When the possibility of using the device arises, pin 60 is pulled out using ring 61, but clip 50 still prevents depression of plunger 30. When likely use of the device becomes imminent, the user inserts a finger into the arch 52 of clip 50 and flips it upwardly over the top of the plunger 30. The plunger can now be depressed, but spring 33 biases it upwardly. Furthermore the recessing of the plunger head in body recess 16 prevents full depression of the plunger if the device is accidentally dropped on a flat surface, because the plunger head does not project substantially beyond the envelope of the body. However the user can conveniently hold the device around its middle/rear grip portion 3, with that portion in the palm of his hand and his thumb on the head of the plunger 30. To fire it he presses the plunger 30 which brings cavity 36 and firing aperture 35 into line with the sprung firing pin 23, which simultaneously is freed from stop surface 38 on the plunger. The stroke limiting effect of pin housing end 25 arrests the plunger so that it cannot bear down too far and interfere with the throw of the firing pin. The firing pin strikes the ca of cartridge 11 through aperture 35 to fire it in the firing chamber 10 and fire the squash ball 7, breaking it free from the adhesive, from the device. Where a plastics diaphragm has been provided, as mentioned above, this can provide a "high/-low" system, ensuring a preliminary build-up of pressure in the chamber which (a) allows proper burning of the propellant and (b) prevents waste of propellant power through premature dislodgement of the ball at the onset of firing. At this time the pad 8 of rubber behind the squash ball 7 helps to prevent piercing of the ball by the explosion, which would reduce the effectiveness of the device. The front surface of the plunger 30 acts as a breech at the rear of the chamber 10.

The high-velocity squash ball gives a substantial body blow to e.g. a violent attacker, which however is very unlikely to cause any serious injury. Simultaneously the loud detonation, emphasised by the very short muzzle length, causes confusion and disorientation.

Subsequently the firing pin 23 remains engaged in cavity 36 of the plunger 30 and effectively locks it in the depressed position. This not only prevents re-use of the device in any way—which in any case is usually impossible because of damage to the front part thereof—but also provides a visual and tactile indication that it is spent.

If the device is not used, split pin 60 can be reinserted and the clip 50 sprung back into its check position.

We claim:

1. A short-range projection device comprising (a) a generally elongate body, the body defining an axis of elongation and having a front end and a rear end, with a grip portion extending axially between the front end and the rear end so as to be grippable in one hand with the hand extending around the axis of elongation;

(b) an axially-forwardly-opening enlarged muzzle defined by the front of the body, for receiving a projectile to be fired by the device;

(c) an axial firing chamber defined in the body behind the muzzle;

(d) a plunger bore defined to extend transversely in the body behind the firing chamber;

(e) a trigger plunger moveable in the plunger bore between a standby condition and a firing condition, the plunger having a rearward stop surface, and defining an axially-extending firing pin recess;

(f) a firing pin guide defined extending axially in the body behind the plunger bore at least partially inside the grip portion, a firing pin movable axially along the firing pin guide, and urging means for urging the firing pin forwardly along the guide;

wherein in the standby condition of the plunger, the stop surface thereof restrains forward movement of the firing pin, while in the firing condition thereof, the firing pin recess thereof allows the firing pin to move forwardly towards the firing chamber under the influence of the urging means, and wherein the trigger plunger emerges to the body exterior at a recessed portion of the body, so that movement of the trigger plunger obtainable by pressing it against a large flat surface is insufficient to reach the firing condition.

2. A device as claimed in claim 1 in which the trigger plunger has a forwardly-facing breech surface which, at least in the firing condition, closes off the rear end of the firing chamber except for a small cylindrical firing hole sized to accommodate the front end of the firing pin.

3. A device as claimed in claim 1 in which the firing pin guide comprises an axially-extending tube in the body, and the firing pin fits in the tube.

4. A device as claimed in claim 1 in which the body consists essentially of an integrated plastics molding 10–20 cm in axial length, and less than 6 cm in width transverse to the axial direction.

5. A device as claimed in claim 1 in which the forward movement of the firing pin traps the trigger plunger in the firing condition and prevents return thereof to the standby condition.

6. A hand-held self-protection device, comprising (a) a unitary molded plastics body having a front end and a rear end, and defining an axial direction, the body comprising a grip portion grippable in one hand, and being less than 30 cm long;

(b) a trigger mounted on the body, operable by a said hand holding the grip portion;

(c) a front muzzle cup defined at the front end of the body, and a squash ball stuck in the front muzzle cup;

(d) a firing chamber defined in the body behind the squash ball, and a blank cartridge in the firing chamber; and (e) firing mechanism in the body, actuable by operation of the trigger to fire the blank cartridge and thereby blow the squash ball out of the front muzzle cup.

7. A device as claimed in claim 6 in which the body is less than 8 cm wide transverse to the axial direction thereof.

8. A device as claimed in claim 6 in which the blank cartridge and the squash ball are less than 4 cm apart.

9. A device as claimed in claim 6 in which a puncture-prevention layer is provided behind the squash ball to inhibit damage thereto by the firing of the charge.

10. A hand-held self-protection device, comprising (a) a unitary molded plastics body having a front end and a rear end, and defining an axial direction, the body comprising a grip portion grippable in one hand, and being less than 30 cm long;

(b) a trigger mounted on the body, operable by a said hand holding the grip portion;

(c) a front muzzle cup defined at the front end of the body, and a soft elastomeric projectile stuck in the front muzzle cup;

(d) a firing chamber defined in the body behind the projectile, and a blank cartridge in the firing chamber;

(e) firing mechanism in the body, actuable by operation of the trigger to fire the blank cartridge and thereby blow the projectile out of the front muzzle cup, and a puncture-prevention layer between the elastomeric projectile and the firing chamber, to inhibit damage thereto by the firing of the charge.

11. A hand-held self-protection device comprising (a) an elongate body, the elongate body having front and rear ends and defining an axial direction, and comprising a grip portion extending axially between the front and rear ends by which the device is grippable in one hand;

(b) a firing chamber defined within the body, and an explosive propellant charge in said firing chamber (c) a firing mechanism in the body, for firing the explosive propellant charge;

(d) a forwardly-opening muzzle recess defined at the front of the elongate body and in front of the firing chamber;

(e) an elastomeric projectile retained in the muzzle recess, said elastomeric projectile having a weight of from 10 to 50 g, and (f) a trigger operable by a hand holding the grip portion to actuate the firing mechanism and thereby fire the propellant charge to discharge the elastomeric projectile from the muzzle with an energy of 40J to about 100J.

12. A device as claimed in claim 11 in which the elastomeric projectile is adhesively retained in the muzzle recess.

13. A device as claimed in claim 11 in which the propellant charge fires to impart an energy of from 40J to 70J to the elastomeric projectile.

14. A device as claimed in claim 11 in which the elastomeric projectile is a ball.

15. A device as claimed in claim 11 in which the elastomeric projectile has a weight of from 20 to 30 g.

16. A device as claimed in claim 11 in which the trigger comprises a trigger piece movable in the elongate body transversely to the axial direction thereof, the firing mechanism comprises a forwardly-biased firing pin, the trigger piece has an opening therefor, and operation of the trigger piece brings the opening and firing pin into register so that the firing pin can move forward.

17. A device as claimed in claim 11 in which the elongate body is an integrated construction of polymeric material, the polymeric material defining the muzzle recess, a firing chamber and grip portion, the grip portion housing the firing mechanism.

18. A device as claimed in claim 11 in which the elongate body is 10 to 20 cm in axial length, and less than 6 cm in transverse width.

19. A hand-held self-protection device for holding in one hand, comprising (a) a body having front and rear ends defining an axial direction, and comprising a grip portion extending axially between the front and rear ends by which the device is grippable in one hand;
(b) a firing chamber defined within the body;
(c) a firing mechanism in the body;
(d) a forwardly-opening muzzle recess defined at the front of the body in front of the firing chamber;
(e) an elastomeric ball in the muzzle recess, said ball having a weight of from 10 to 50 g;
(f) an explosive propellant charge in the firing chamber to impart to the elastomeric ball an energy of from 40 to 70J upon firing thereof; and
(g) trigger means, operable by a hand holding the grip portion to actuate the firing mechanism and fire the explosive propellant charge to eject the elastomeric ball with said energy.

20. A device as claimed in claim 19 in which the elastomeric ball is a squash ball.

21. A device as claimed in claim 19 in which the elastomeric ball has a weight of from 20 to 30 g.

22. A device as claimed in claim 19 in which the trigger comprises a trigger piece movable in the elongate body transversely to the axial direction thereof, the firing mechanism comprises a forwardly-biased firing pin, the trigger piece has an opening therefor, and operation of the trigger piece brings the opening and firing pin into register so that the firing pin can move forward.

23. A device as claimed in claim 22 in which the trigger piece emerges to the body exterior at a recessed portion of the body, whereby the trigger piece cannot be pressed sufficiently to actuate the firing mechanism by pressing against a large flat surface.

24. A device as claimed in claim 22 comprising a safety arrangement for preventing inadvertent actuation of the firing mechanism, the safety arrangement comprising a resilient spring clip having outer limbs engaging the trigger piece and a check loop which is resiliently deformable relative to the outer limbs and which engages in a check groove of the trigger piece while abutting against the body of the device to prevent operation of the trigger piece until it is pivoted about the outer limbs to disengage the check loop.

25. A device as claimed in claim 19 in which the body is an integrated construction of polymeric material, the polymeric material defining the muzzle recess, firing chamber and grip portion, the grip portion housing the firing mechanism.

26. A hand-held self-protection device comprising (a) a body, the elongate body having front and rear ends and defining an axial direction, with a grip portion extending axially between the front and rear ends and by which the device is grippable in one hand;
(b) a firing chamber defined within the body, and an explosive propellant charge in said firing chamber;
(c) a firing mechanism in the body for firing the explosive propellant charge;
(d) a trigger plunger extending transversely in the body and operable by a hand holding the grip portion to actuate the firing mechanism;
(e) a muzzle recess at the front of the body for receiving a soft low-density projectile to be fired by the device;
(f) a safety arrangement for preventing inadvertent operation of the trigger plunger, in which the trigger plunger emerges to the body exterior at a recessed portion of the body whereby the trigger plunger cannot be moved sufficiently to actuate the firing mechanism by pressing against a large flat surface, and which further comprises a spring clip fitted to the trigger plunger at the exterior of the device, the spring clip having outer limbs engaging the trigger piece and a check loop which is resiliently deformable relative to the outer limbs, the spring clip being movable between a safety condition , in which the check loop engages the body of the device and a check groove of the trigger plunger, and a standby condition in which the check loop is disengaged from said check groove.

27. A hand-held self-protection device, comprising (a) a body having a front end and a rear end and defining an axial direction, the body comprising a grip portion grippable by one hand, and being less than 30 cm long;
(b) a trigger mounted on the body, operably by a hand holding the grip portion;
(c) a front muzzle cup defined at the front end of the body, and a squash ball stuck in the front muzzle cup;
(d) a firing chamber defined in the body behind the squash ball for holding a blank cartridge in the firing chamber, and
(e) firing mechanism in the body, actuable by operation of the trigger to fire the blank cartridge and thereby blow the squash ball out of the front muzzle cup.

28. A device as claimed in claim 27, in which the propellant charge fires to impart an energy of from 40J to about 100J to the squash ball.

29. A device as claimed in claim 27 in which the stuck squash ball projects from the front muzzle cup.

* * * * *